US010893744B2

(12) United States Patent
Lopiccolo

(10) Patent No.: US 10,893,744 B2
(45) Date of Patent: Jan. 19, 2021

(54) ALL-IN-ONE ANTIMICROBIAL HAND/NAIL BRUSH

(71) Applicant: June M Lopiccolo, Boynton Beach, FL (US)

(72) Inventor: June M Lopiccolo, Boynton Beach, FL (US)

( * ) Notice: Subject to any disclaimer, the term of this patent is extended or adjusted under 35 U.S.C. 154(b) by 0 days.

(21) Appl. No.: 16/281,742

(22) Filed: Feb. 21, 2019

(65) Prior Publication Data

US 2020/0268137 A1 Aug. 27, 2020

Related U.S. Application Data

(60) Provisional application No. 62/710,935, filed on Mar. 5, 2018.

(51) Int. Cl.

| | |
|---|---|
| ***B43K 5/14*** | (2006.01) |
| ***A46B 11/00*** | (2006.01) |
| ***A46B 9/00*** | (2006.01) |

(52) U.S. Cl.

CPC ..... *A46B 11/0041* (2013.01); *A46B 9/005* (2013.01); *A46B 11/0003* (2013.01); *A46B 11/0062* (2013.01); *A46B 11/0086* (2013.01); *A45D 2200/1045* (2013.01); *A46B 2200/1013* (2013.01); *A46B 2200/1093* (2013.01)

(58) Field of Classification Search

CPC ..... A46B 11/0041; A46B 11/0065; A46B 11/0062; A46B 11/0075; A46B 11/0086; A46B 2200/1013; A46B 2200/30; A46B 9/005; A45D 2200/1045

USPC ..... 401/183, 133, 17

See application file for complete search history.

(56) References Cited

U.S. PATENT DOCUMENTS

| | | | | |
|---|---|---|---|---|
| 2,879,532 | A * | 3/1959 | Szabo | A47L 13/022 401/24 |
| 3,704,072 | A * | 11/1972 | Kaufman | A46B 9/02 401/291 |
| 4,430,013 | A * | 2/1984 | Kaufman | A45D 34/04 401/132 |
| 5,312,197 | A * | 5/1994 | Abramson | A46B 9/02 15/105 |
| 6,491,928 | B1 * | 12/2002 | Smith, III | A61F 13/36 424/401 |
| 7,008,132 | B1 * | 3/2006 | Phua | A46B 11/001 401/125 |
| 7,540,680 | B2 * | 6/2009 | Feldman | A46B 11/0003 401/183 |

(Continued)

*Primary Examiner* — Jennifer C Chiang

(57) ABSTRACT

This personal All in One Antimicrobial Hand Brush offers a novel function from the existing art. The most convenient and effective method for removing pathogens from the hands whether at home or outside the home. It includes a bristle side used for sweeping under the nailbed and a sponge side to clean the hands. Both sides are connected to a base containing a chamber inside. The chamber contains a barrier filled with a personal care solution(s) released by squeezing the hourglass indentation after pulling the tab to remove the barrier. The barrier prevents the solution from leaking prior to use. The device will also be available to provide the same optimal method to clean in-between pet paws for dogs and cats. Pets commonly carry pathogens found in soil and grass. Wiping paw pads alone will not remove these pathogens similar to hand washing without sweeping under the human nail bed.

14 Claims, 2 Drawing Sheets

(56) References Cited

U.S. PATENT DOCUMENTS

| | | | | |
|---|---|---|---|---|
| 8,157,464 | B2 * | 4/2012 | Prax | A45D 34/04 401/132 |
| 2016/0106290 | A1 * | 4/2016 | Perry | A46B 15/0055 15/114 |

* cited by examiner

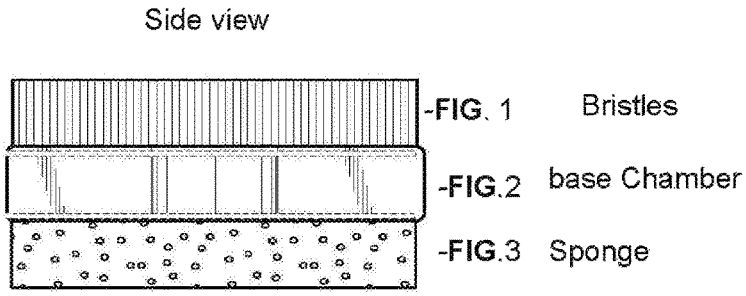
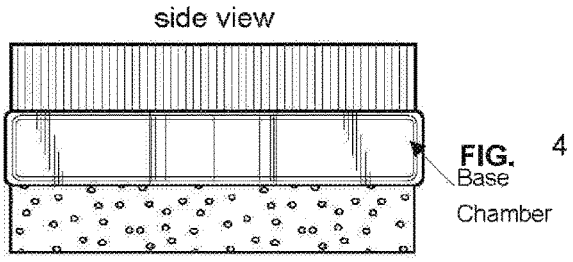
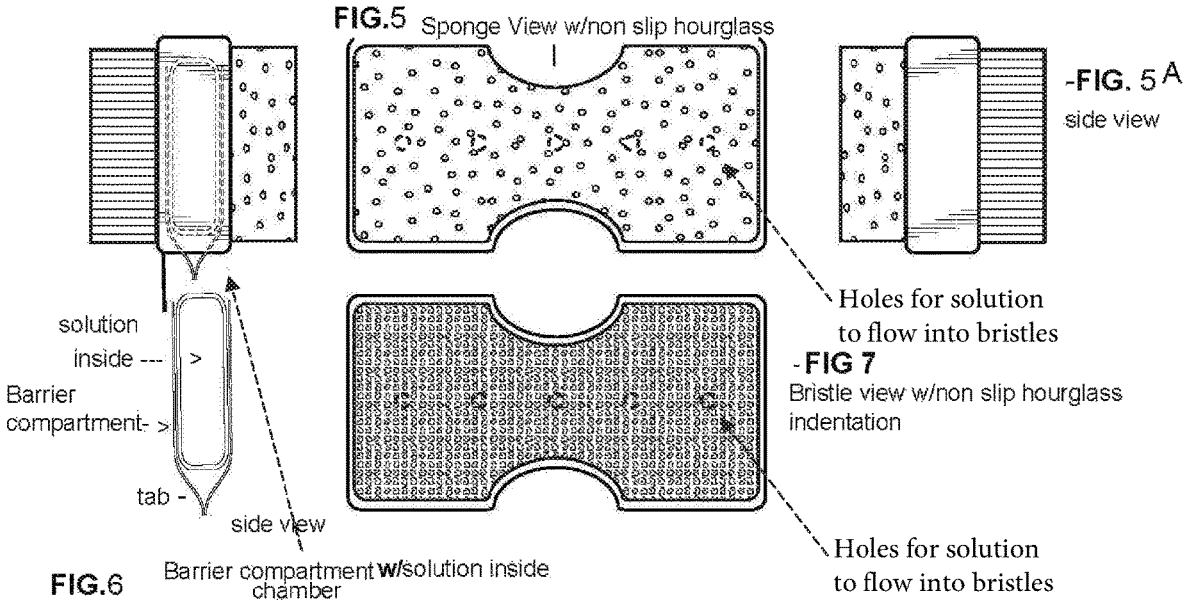
FIG.6

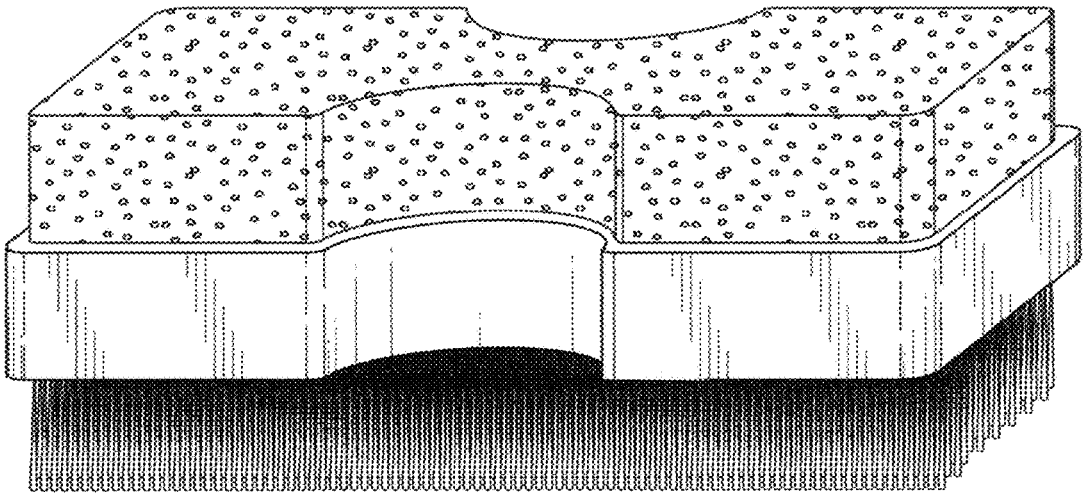
FIG. 1 A -view of hand/nailbrush showing base, hourglass indentation non -slip groove, sponge and bristle sides

ALL-IN-ONE ANTIMICROBIAL HAND/NAIL BRUSH

INVENTION OVERVIEW

Purpose of Invention

Cleansing and removal of pathogens from hands, nails, and nailbed known as the subungual space.

Description of Problem(s) that this Invention Solves

This device for consumer use containing a personal hygiene solution increases cleansing and optimal pathogen removal without scratching skin surface at the same time sweeping the nails and subungual space without slipping, simultaneously and without the need to add a personal hygiene solution separately, adding convenience, safety and efficacy. It will be two sizes, one to be carried and used without becoming contaminated, increasing usage and prevention of the spread of pathogens and/or reinfection for both adults and children. It will be marketed in these two sizes for home and portable usage. This solves the problem of nail cleaning, hand cleaning without scratching bringing pathogens into broken skin, no need for separate cleanser, and will not slip with the hourglass shape while using in and outside the home.

Individual and Business Demographics that would Use this Invention

This invention will be marketed to the Retail market for consumer use in the home for adults, children, and pets. It will also be marketed for travel and carry outside the home for a one time sanitary disposable use for children, adults and pets in a portable size. The one time use will be sold retail in small bulk quantity. The pet version will be sold as one size in small bulk quantity.

This device invention will also be marketed to the Commercial Market for consumer individual use for schools, clinics, hospitals, daycare centers, gyms, airports, and all restaurants both fast food and eat in and any business where there is a need particularly for food handlers to wash hands to remove pathogens. These will be individually wrapped single use disposable units sold in large bulk quantity for both children and adults.

Description of the Benefits of this Invention to its Users

This device unlike any other has the ability to do all the above in the most effective, safe and convenient manner in an all in one-step, in and outside of the home. This will be for adults, children and pets to reach in-between paw pads. This also will provide consumers with choices of different personal hygiene solutions, in addition to the home refillable version.

BRIEF DESCRIPTION OF THE INVENTION

Background

The present technology relates to a device and method for cleaning the skin and nails, and under the nailbed.

Brushes are commonly used for personal hygiene and grooming. In particular, nailbrushes are used to remove bacteria and other pathogens from the nails and under the nail bed, known as the subungual space. It is known that the hands and fingernails carry dirt, bacteria and disease causing pathogens, however the fingernails harbor the highest percentage of unwanted dirt and pathogens as compared to other parts of the hand. The region under the fingernail, the nailbed, known as the subungual space carries the most; it contains approximately 99% of the pathogens that are on the hand presenting a special problem for their effective removal. The pathogens on the hands and nails have been responsible for food-borne illness outbreaks and the spread of other diseases such as the common cold and flu, now other food borne pathogens such as hepatitis. Children in particular are prime carriers of spreading disease and illness because they are amongst the largest pathway for the spread of these pathogens to each other, their family members and the community. Washing the hands alone, vital as recommended by the CDC while more effective than using sanitizer alone or not washing, can leave behind most of the pathogens in the subungual space.

A fingernail brush is the only effective method in removing such pathogens. When combined with antiseptics such as alcohol and/or soap, or a combination of both as most effective, the nailbrush significantly reduces the percentage of pathogens, and the spread of disease. Cleaning between paw pads will also prevent infection to pets, and spreading to family members that wipes cannot reach.

Hygiene scrub brushes have been used in the art, however, there are significant differences between the present technology and what is already known. Although there are references to surgical scrub brushes and others, some containing a solution, the present technology fundamentally diverges from these references. In existing personal scrub brushes, the designs do not feature both bristles for the nails and nailbed, combined with a sponge to clean the skin without scratching the skin surface further that can spread any existing pathogens below the skin surface that features a unique compartment housing a personal care solution that will optimally clean both the nails and skin without scratching, in one convenient step at the same time. Nor do existing surgical or personal scrub brushes prevent slipping using a non-slip hourglass shape that surrounds to finger(s) while in use by simultaneously squeezing to release solution decreasing effectiveness and/or contamination from slipping. Further, many personal devices currently in use for cleaning under the fingernails are large, complicated devices for use in professional salons, on a cabinet top at home or in the form of a small travel size brush that will be exposed to germs before and after use due to traveling without a contained personal hygiene solution that will be released simultaneously into the bristles and sponge. These personal hygiene brushes do not house a solution(s) with an hourglass non-slip grip meant for finger hold and release into the sponge and nail bed. They are for the purpose of the nails only, release into one side of the brush, and/or there is an additional step to clean the hands. Therefore, a need exists for an improved personal at home and one-time-use portable disposable and germ-free brush that features this unique non-slip grip that will allow a person to release one or more personal care solution(s) of their choice onto their skin, nails and sweep the nailbed to most effectively, efficiently and conveniently prevent infecting themselves and others in one step, a practical, and functional improvement upon any personal hygiene brush.

There is also a vital need for an effective and convenient method for cleaning in-between pet paw pads. Nor is there anything such as this device in commercial establishments, which usually house only sanitizers that do not sweep under the nail bed leaving pathogens

BRIEF SUMMARY

In certain embodiments, the present technology provides a hygiene device comprising:

a) a support member having a sponge portion on a first side and a bristle portion on a second side opposite the first side;

b) a chamber located within the support member, the chamber adapted to house a personal care solution; and c) A finger indentation; wherein a portion or all of the device comprises an hour glass shape.

In certain embodiments, the present technology provides a hygiene device comprising:

a) a support member having a sponge portion on a first side and a bristle portion on a second side opposite the first side;

b) a chamber located within the support member, the chamber adapted to house a personal care solution; and c) A removable barrier located between the chamber and the first side or the second side or both.

In certain embodiments, the present technology provides a method of cleaning the skin: squeezing a device using the non-slip grip of the present technology to release the personal care solution onto the skin and/or nails, and subungual space from the chamber.

DETAILED DESCRIPTION

As used herein "chamber" refers to an enclosed space or cavity. As used herein "personal care solution" refers to any composition that is useful for personal care. Personal care can be, but is not limited to; cosmetic cleaning, antiseptic, antimicrobial, conditioning, sanitizing, moisturizing, skin protective agent, washing hair, skin, fingernails, arms, hands. Personal care solution compositions can include, but are not limited to: water, alcohol, glycerin, butyrospermumparkii (shea butter), cyclopentasiloxane, sodium PCA, Panthenol, dimenthiconol, sodium Polyacrylate, chlorhexidine gluconate, triclosan, triclocarban, chloroxylenol, tetrasodium EDTA, isopropyl alcohol, ethanol, n-propanol, povidone-iodine, polyacrylic acid, propylene glycol, benzalkonium chloride, ethylhexyl ethylhexanoate, isohexadecane, lanolin alcohol, myristyl alcohol, dimethicone, petrolatum, paraffin, sorbitol, sodium hyaluronate, propylene glycol, alpha hydroxyl acids, sugars, film-forming polymers, botanical extracts, hair fixative polymers, emulsifiers, peptides, polymers, silicones, sterilants, sufacants, acids, acrylic acid, acrylamidomethyl propane sulfonic acid copolymer, acrylates, beheneth-25 methacrylate copolymer, esters, peg-90 diisostearate, peg/ppg-8/3 diisostearate, peg/ppg-8/3 laurate, polyglyceryl-3 laurate, methyl glucoside derivatives, polyquaterniums, acrylates, acrylamide copolymer, sodium acrylates, beheneth-25 methacrylate crosspolymer, hydrogenated polydecene, lauryl glucoside, c10-30 alkyl acrylate crosspolymer, monohydric alcohol esters, monohydric alcohol di/tri esters, polyhydric alcohol esters, mineral oil, polysorbate-85, starch hydroxypropyl trimonium chloride, polyamide, cassia hydroxypropyltrimonium chloride, peracetic acid, hydrogen peroxide, sporicide, peroxyacetic acid, sodium chloride, lactic acid, octanoic acid, peroxyacetic acid, ethlyene oxide, sodium chlorite, sodium dichloroisocyanurate, soap, shampoo, conditioner, creams, exfoliators, toners, vitamins, sunscreen, essential oils and lotion or any combination of any of the forgoing.

In certain embodiments, the personal care solution comprises an anti-microbial solution comprising soap or alcohol, alone or in combination.

In certain embodiments, a device of the present technology can contain multiple chambers within the support member. One of more chambers can be adapted to house a personal care solution.

In certain embodiments, the support member can house more than one chamber, wherein one or more of chambers is capable of housing multiple solutions. That is, the sponge portion can contain an individual personal care solution that allows a user to clean any part of the body, e.g., hands, palms, arms or wrists without scratching, breaking the skin or increasing any breaks in the skin. The bristle portion can contain an individual personal care solution that aids in sweeping under the nail bed, the subungual space.

As used herein a finger refers to the finger of any mammal, including a human finger.

As used herein an "hour glass shape" is defined as a shape wider at its ends and narrower in the middle, and having a slimmer or narrower waist, midsection, or joining segment, as shown, for example, in FIGS. 5, 7.

In certain embodiments, the present technology can have a small hour glass indentation capable of allowing only a single finger to grip each side, as shown, for example in FIGS. 5, 7. That is, a person can grip the device with their thumb and one of a pointer, ring, middle, or pinky finger. A person may also grip the device with both of their thumbs, or another combination of fingers when using both hands to grip the device. It is also possible to grip the device with toes, if the person has the necessary dexterity.

In certain embodiments, the present technology can have an hour glass indentation capable of supporting a plurality of fingers. That is, a person can grip the device using one, two, three, four, or five fingers. In certain embodiments, the hour glass indentation can have a non-slip grip. As used herein a "non-slip grip" is defined as supporting to preventing slipping or sliding of the device out of the hand, and part or losing all contact with the hand when holding the device. This embodiment can enhance use by preventing it slipping from hands while using personal hygiene solutions. In certain embodiments, the hour glass indentation provides for the non-slip grip. In such embodiments the indentation would prevent the fingers from slipping. In certain embodiments, raised ridges surrounding the hour glass indentation provide the structure for the non-slip grip.

In certain embodiments, the present technology may provide a loop around the hour glass indentation. As used herein a "loop" is defined as a curved cord, ribbon, or any other material folded or doubled upon itself so as to leave an opening between the parts.

In certain embodiments, the user holds the device by putting one or more fingers through the loop. In other embodiments, the user places one or more fingers through the loop when using the device to prevent the device from accidently falling and making contact with the floor or any other surface.

In certain embodiments, the present technology provides a barrier or film between the sponge and the personal care composition. The barrier can prevent release of the personal care composition to the bristle or sponge. The barrier can be made of, but is not limited to, cellophane, plastic, glass, rubber or any polymeric material. The barrier in certain embodiments can be pulled and lifted to release the personal care solution. In certain embodiments, after removing the barrier, the personal care solution is released automatically, or is released with light pressure or by squeezing of the sides of the device. In certain embodiments, one barrier is located at the junction of the chambers and the sponge and bristle portion. In such embodiment, only one barrier has to be removed for release of the solution onto the sponge portion, the bristle portion or both the sponge and the bristle portion.

In certain embodiments, the present technology contains a chamber that forms a gap between the sponge and bristle portion. That is, the gap between the sponge and bristle portion is more pronounced, allowing a user to utilize either the sponge portion or the bristle portion with ease. In certain embodiments, this also permits easy access to the chambers for, e.g., replacing or refilling the personal care composition, or for cleaning.

In certain embodiments, the present technology can be squeezed and the personal care composition can be released only into the bristle portion. That is, one or more holes on the bristle portion of the device allow the personal care solution to be released.

In certain embodiments, the present technology can be squeezed and the personal care composition can be released only into the sponge portion after removing the barrier, or applying pressure to the device.

In certain embodiments, the present technology can be squeezed and release only a cleaner, only a moisturizing solution, or both a cleaner and a moisturizing solution, onto one or both the bristle portion or sponge portion.

In certain embodiments, applying pressure on different pressure points can release different personal care solutions such as a cleaner or moisturizer. As used herein a "pressure point" is defined as a location on the hygiene device where pressure is applied to release a personal care solution.

In certain embodiments, applying pressure on different pressure points can release the personal care solutions on either the sponge portion or the bristle portion.

In certain embodiments, the present technology can be squeezed to release a personal care solution that is meant to be rinsed off the skin, or it may not be rinsed off the skin, but may be left on the skin, and permitted to coat the skin or be absorbed into the skin.

In certain embodiments, the present technology can be squeezed to release a cleaner to effectively remove and enhance hand cleaning, moisturizer to avoid the spread of pathogens, or a moisturizer solution that is not washed off to reduce reinfection of pathogens.

In certain embodiments, the devices of the present technology can be refilled and reused multiple times. That is, when the chamber is empty, a person can refill the personal care solution on their own by disassembling. In other embodiments, a person can also refill the empty chamber without disassembling the device, through the use of any tool that assists with deploying a solution into a chamber.

This tool can be, but is not limited to, a pump bottle with a nozzle, a syringe, a squirt gun, a spray bottle, a hose, a funnel, a tube, or a piping bag through an opening on a side of the base of the brush.

In certain embodiments, the device is for one time disposable use. That is the device will be discarded after each use to reduce the spread of pathogens. In certain embodiments, the device is for use outside of the home. In certain embodiments, the device is used until the solutions in the chambers are finished, or the sponge portion or the bristle portion has worn out or lost its efficacy.

In certain embodiments, a device of the present technology can be pressed against a firm surface to release the personal care solution. That is, a person grips the device and applies pressure to device by placing it against an object, such as but not limited to, a table, a desk, a wall, any part of the body, a bathroom surface, a book, or any firm or durable surface.

In certain embodiments, a device of the present technology can release the personal care solution by removing the aforementioned barrier. That is, a person makes contact with the barrier and exerts force on the barrier thus detaching the barrier from the support member for example, pulling the barrier out of the space in the device in which it is lodged, allowing the personal care solution to permeate the sponge and bristle portion or just the sponge portion, or just the bristle portion.

In certain embodiments, the device is packaged individually. That is, each device can be individually wrapped to prevent contamination.

In certain embodiments, the personal care solution inside the base can be contained by a material including but not limited to cellophane type material that has a pull tab until ready for use. Upon pulling the tab and removing it from the device from one end, it can release the antimicrobial solution into the bristles and sponge sides through micro holes located in the base of both sides upon pressure and squeezing the hourglass indentation when in use.

In certain embodiments, any of the device base and bristles portions of the brush can be made up of the same or different soft plastics, while the hourglass indentation will be made up of a soft but firmer plastic, including but not limited to PET, HDPE, PVC, LDPE, PP, or PS.

In certain embodiments, the device can house a cellophane cartridge or other such similar material with tabs that extend outside the brush ready to be pulled out to enable the solution to enter the bristles and sponge when ready for the first time use.

In certain embodiments, the device can be refilled through an opening at one end of the brush base every 30-45 days.

In certain embodiments, the devices herein can be sold in multiple commercial embodiments; e.g., as a line of retail individual disposable, home line of products; or commercial line. In certain embodiments, consumers may be offered a choice of solutions such as a natural or synthetic solution. For example, someone who wants only natural solutions can choose from a variety of essential oils.

DESCRIPTION OF DRAWINGS

FIG. 1 A view of a hand/nailbrush at an angle showing base, hourglass indentation non-slip grip groove; sponge and bristle sides;

FIGS. 1-7 illustrate certain exemplary embodiments of devices according to the present technology.

FIG. 7 shows the view of the Bristle view (1) of the present technology with an hour glass FIG. 2.

FIG. 5A shows the opposite side of the present technology, the sponge view portion without cartridge FIG. 6 shows side view of both bristle and sponge with base holding cartridge that has cellophane type material with a pull tab for easy removal that holds containing solution to be released.

FIG. 5 shows a view of the present technology, displaying the sponge side with hourglass non slip indentation FIG. 4 shows side view of the present technology, displaying the sponge and bristle portion as well as the base chamber for the personal care solution FIGS. 3, 2, 1 shows device looking side view of FIG. 1 Bristles FIG. 2. Base Chamber FIG. 3. Sponge

I claim:

1. A hygiene device comprising:

a) a support member having a sponge portion on a first side and a bristle portion on a second side opposite the first side;

b) a chamber located within the support member; the chamber adapted to house a liquid personal care solution contained in a barrier within the chamber with a barrier tab extending outside the chamber;

c) a finger indentation wherein a portion of the device comprises an hourglass shape, which may or may not have ridges and/or a nonslip grip.

2. The hygiene device of claim 1, further comprising a removable barrier to contain said liquid personal care solution, which is released by pulling the barrier tab.

3. The hygiene device of claim 1, comprising a single-finger hourglass indentation.

4. The hygiene device of claim 1, comprising an hourglass indentation supporting two or more fingers.

5. The hygiene device of claim 1, comprising a loop around the hour glass indentation.

6. The hygiene device of claim 1, comprising a non-slip hourglass indentation.

7. The hygiene device of claim 1, wherein the liquid personal care solution in the chamber is released into the bristles and sponge by applying pressure to the hourglass indentation once the removable barrier is pulled out by the barrier tab.

8. The hygiene device of claim 1, comprising holes for the release of a liquid personal care solution on the first side and the second side of the support member.

9. The hygiene device of claim 1, wherein the support member is made of a flexible material and is squeezable.

10. The hygiene device of claim 1, wherein the chamber is refillable when desired.

11. The hygiene device of claim 1, wherein the hygiene device is disposable and for one-time use.

12. The hygiene device of claim 1, wherein the hygiene device is individually wrapped.

13. The hygiene device of claim 1, comprising a gap between the sponge and bristle portion.

14. A hygiene device comprising:

a) a support member having a sponge portion on a first side and a bristle portion on a second side opposite the first side, b) a chamber located within the support member, the chamber adapted to house a personal care solution and;

c) wherein said personal care solution is contained in a removable barrier, said personal care solution is released into the chamber and into the sponge and bristles by pulling an attached barrier tab extending outside the chamber and applying pressure to the support member.

* * * * *